US005876220A

United States Patent [19]

Yeh

[11] Patent Number: 5,876,220

[45] Date of Patent: Mar. 2, 1999

[54] ELECTRICAL CONNECTOR FOR HORIZONTAL INSERTION OF A CPU MODULE THEREIN

[76] Inventor: Te-Hsin Yeh, No. 45, Tung Yuan Road, Chungli, Taoyuan County, Taiwan

[21] Appl. No.: 764,257

[22] Filed: Dec. 12, 1996

[51] Int. Cl.[6] ..... H01R 9/09

[52] U.S. Cl. ..... 439/79

[58] Field of Search ..... 439/79, 59, 62, 439/80, 631

[56] References Cited

U.S. PATENT DOCUMENTS

| | | | |
|---|---|---|---|
| 3,530,422 | 9/1970 | Goodman | 439/62 X |
| 4,992,052 | 2/1991 | Verhoeven | 439/79 X |
| 5,316,489 | 5/1994 | Kachlic | 439/79 OR |

*Primary Examiner*—Paula Bradley
*Assistant Examiner*—Daniel Wittels
*Attorney, Agent, or Firm*—Birch, Stewart, Kolasch & Birch, LLP

[57] ABSTRACT

An electrical connector for horizontal insertion of a CPU module therein includes a connector body and a multiplicity of terminals fitted in the connector body. The connector body has a longitudinal insert slot for receiving a CPU module. The terminals form elastic contact ends at their outer ends for clamping a contact surface of a circuit board which have its two ends respectively fit into the grooves of a locking device of the connector body. Screws may be driven into through holes of the locking device to secure the connector body horizontally at the side of the circuit board for horizontal insertion of the CPU module into the insert slot of the connector body.

1 Claim, 2 Drawing Sheets

FIG. 1B
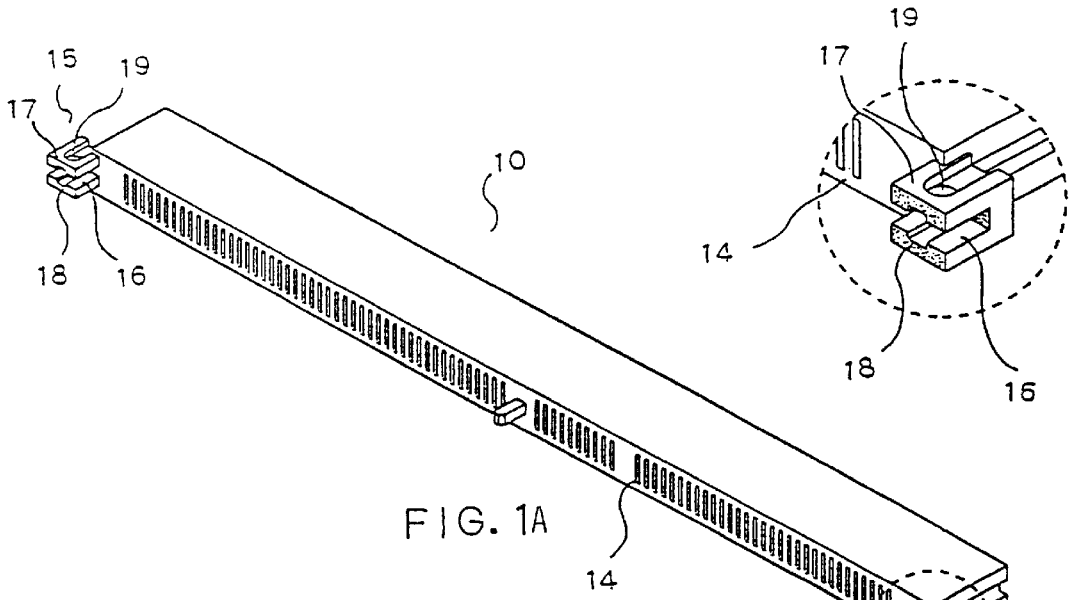
FIG. 1A
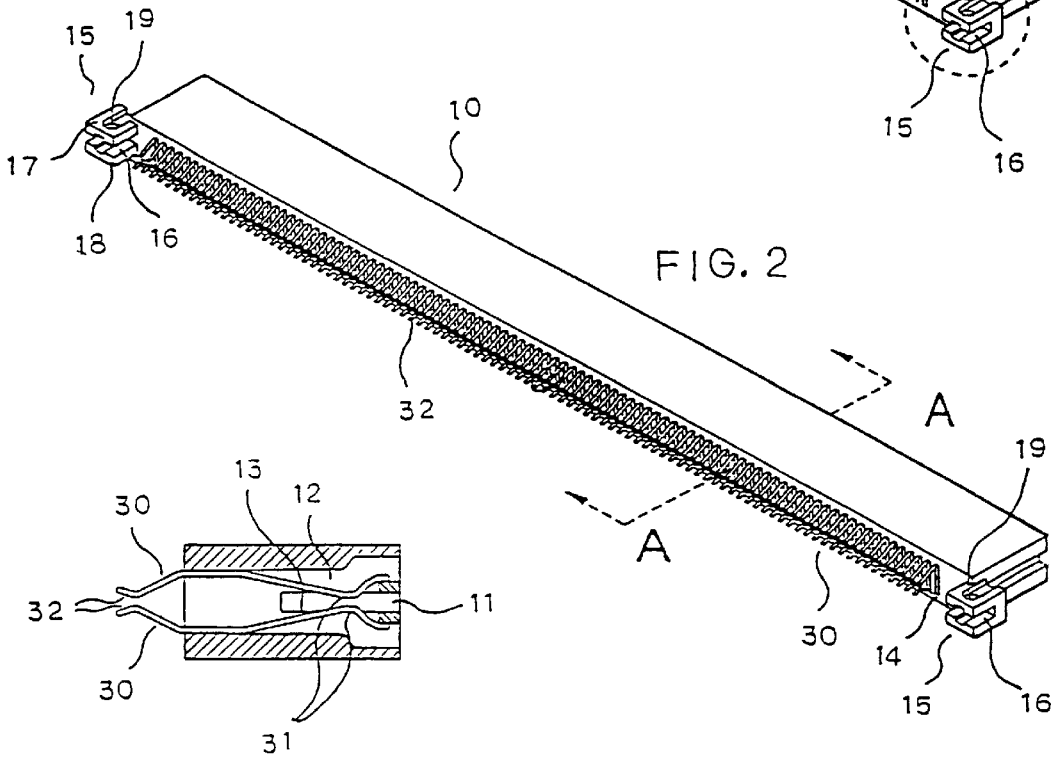
FIG. 2
FIG. 3

ELECTRICAL CONNECTOR FOR HORIZONTAL INSERTION OF A CPU MODULE THEREIN

BACKGROUND OF THE INVENTION (a) Field of the Invention:

The present invention relates generally to an electrical connector, and more particularly to an electrical connector which may be mounted easily and allow a CPU module to be horizontally inserted therein so as to effectively reduce the height of the computer mainframe.

(b) Description of the Prior Art:

Most conventional electrical connectors are mounted on circuit boards by means of the insertion of the pins of terminals at their lower sides into corresponding securing holes of the circuit boards. Although such a method of mounting has been widely adopted in the art, the CPU module must be vertically inserted into the longitudinal slot of the electrical connector. Under the trend of making everything compact, such vertical insertion of CPU modules into electrical connectors will not allow for reduction in the height of the computer mainframe. This problem intensifies with mainframes using large CPU modules.

Besides, there is another problem that some of the contact pins of the terminals of the conventional electric connector may become bent or broken so that they cannot fit smoothly into the securing holes of the circuit board.

SUMMARY OF THE INVENTION

Accordingly, a primary object of the present invention is to provide an electrical connection for mounting at the side of a circuit board to allow horizontal insertion of a CPU module therein in which the terminals of a connector body have elastic contact ends clamp the corresponding contact surface of the circuit board.

Another object of the present invention is to provide an electrical connection for mounting at the side of a circuit board to allow horizontal insertion of a CPU module therein, in which a connector body is provided with elastic contact ends and locking means to enable the connector body to be easily and effective secured at the side of the circuit board.

BRIEF DESCRIPTION OF THE DRAWINGS

The foregoing and other features and advantages of the present invention will be more clearly understood from the following detailed description and the accompanying drawings, in which, FIG. 1A is an elevational view of the connector body of the present invention prior to the installation of the terminals;

FIG. 1B is an enlarged view of the end of the connector body of FIG. 1A;

FIG. 2 is an elevational view of the connector body of the present invention after the installation of the terminals;

FIG. 3 is a sectional view of FIG. 2 taken along line A—A; and

DETAILED DESCRIPTION OF THE PREFERRED EMBODIMENT

Figure 4:
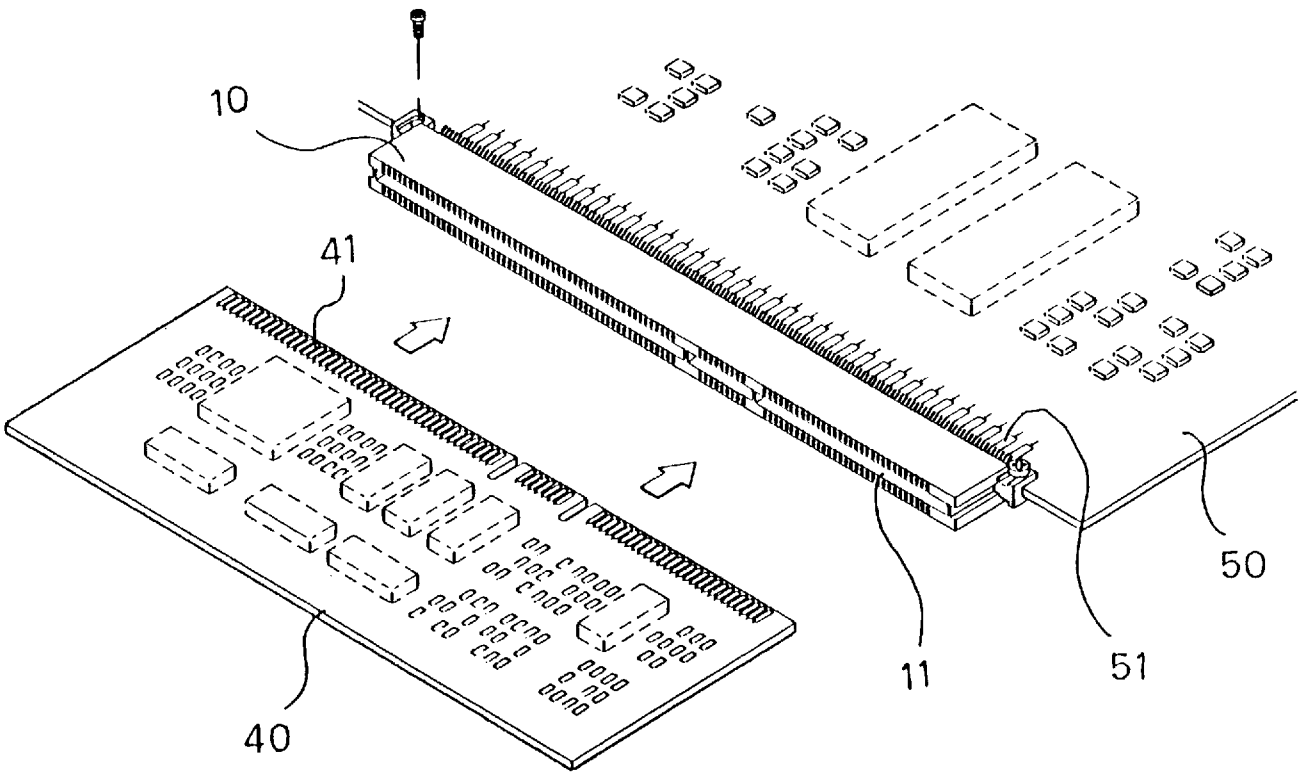
FIG. 4 is a schematic view illustrating the assembly of the electrical connector of the present invention, the circuit board and a CPU module.

With reference to FIGS. 1–3, the electrical connector according to the present invention essentially comprises a connector body 10 and a multiplicity of terminals 30 fitted in the connector body 10. The connector body 10 is provided with a longitudinal insert slot 11 (as shown in FIG. 4) for receiving a CPU module 40 therein; a plurality of terminal securing slots 12 are arranged in two corresponding lines respectively disposed on both sides of the insert slot 11. The terminal securing slots 12 are respectively provided with openings 13 communicating with the insert slot 11 so that, after the terminals 30 are secured in the corresponding terminal securing slots 12, the protrudent contact ends 31 of the terminals may extend via the openings 13 into the insert slot 11 to provide a connection between the terminals 30 with a contact surface 41 of the CPU module 40.

An outwardly extending locking means 15 is disposed at either end of an outer side 14 opposite to the insert slot 11. A central portion of the locking means 15 is provided with a longitudinal insert groove 16 defined by two side walls 17 and 18. The side walls 17 and 18 are respectively provided with a corresponding through hole 19, 20.

In addition, the terminals 30 extending from the outer side 14 of the connector body 10 are configured to bend from the side of the connector body 10 to the center before bending outwardly so that the terminals 30 at both sides of the connector body 10 may form corresponding elastic contact ends 32 near their outer ends. Therefore, when the contact ends 32 are used to clamp the corresponding contact surface 51 at the side of the circuit board 50 and when both ends of the contact surface 51 are respectively fitted into the grooves 16 of the locking means 15 of the connector body 10, by means of screws 60 driven into the through holes 19 and 20 of the locking means 15, the connector body 10 may be horizontally disposed at the side of the circuit board 50.

After the connector body 10 is mounted on the circuit board 50, its longitudinal insert slot 11 faces the outer side of the circuit board 50. Therefore, the CPU module 40 may be horizontally inserted into the insert slot 11 of the connector body 10.

In summary, the present invention provides an easy and simple mounting of an electrical connector at one side of a circuit board to allow horizontal insertion of a CPU module into the insert slot of the electrical connector, thus making it possible to reduce the height of the computer mainframe.

Although the present invention has been illustrated and described with reference to the preferred embodiment thereof, it should be understood that it is in no way limited to the details of such embodiment but is capable of numerous modifications within the scope of the appended claims.

What is claimed is:

1. An electrical connector for horizontal insertion of a CPU module therein, comprising a connector body and a multiplicity of terminals fitted in said connector body, wherein said connector body has a longitudinal insert slot for receiving a CPU module, a multiplicity of terminal securing slots being arranged in two lines each of which is disposed on either side wall of said insert slot for matching said terminals, said terminal securing slots each being provided with an opening communicating with said insert slot, after said terminals have been secured in the corresponding terminal securing slots, a protrudent contact end of each terminal is extendable via said opening into said insert slot to achieve connection between said terminals and a contact surface of said CPU module, the connector body having an outwardly extending locking means disposed at either end of an outer side at an opposite side of said insert slot, the locking means having a longitudinal groove at a central portion, said groove being defined by two side walls each of which has a through hole; and said terminals are each configured to bend from the side of said connector body towards the center and then bend outwardly, so that said terminals form corresponding elastic contact ends near their outer ends, thereby when said elastic contact ends of said terminals clamp the corresponding contact surface at the side of a circuit board and when the two ends of said circuit board are fitted into said grooves at both ends of the locking means, by means of screws driven into said through holes of said locking means, said connector body is horizontally securable at the side of said circuit board for horizontal insertion of said CPU module.

* * * * *